US010230163B2

(12) United States Patent
Adams et al.

(10) Patent No.: US 10,230,163 B2
(45) Date of Patent: Mar. 12, 2019

(54) MONOPULSE AUTOTRACKING SYSTEM FOR HIGH GAIN ANTENNA POINTING

(71) Applicant: The Johns Hopkins University, Baltimore, MD (US)

(72) Inventors: Norman H. Adams, Fulton, MD (US); Hermann B. Sequeira, Severna Park, MD (US); Matthew G. Bray, Ellicott City, MD (US); Dipak K. Srinivasan, Highland, MD (US); Ron C. Schulze, Ellicott City, MD (US)

(73) Assignee: The Johns Hopkins University, Baltimore, MD (US)

( * ) Notice: Subject to any disclaimer, the term of this patent is extended or adjusted under 35 U.S.C. 154(b) by 492 days.

(21) Appl. No.: 14/884,996

(22) Filed: Oct. 16, 2015

(65) Prior Publication Data

US 2016/0118715 A1 Apr. 28, 2016

Related U.S. Application Data

(60) Provisional application No. 62/067,530, filed on Oct. 23, 2014.

(51) Int. Cl.
*H01Q 3/02* (2006.01)
*H01Q 1/28* (2006.01)
*H01Q 25/02* (2006.01)

(52) U.S. Cl.
CPC ..... *H01Q 3/02* (2013.01); *H01Q 1/288* (2013.01); *H01Q 25/02* (2013.01)

(58) Field of Classification Search
CPC ..... H01Q 1/28; H01Q 1/288; H01Q 1/364; H01Q 3/02; H01Q 25/02; H01Q 25/04
USPC ..... 342/427
See application file for complete search history.

(56) References Cited

U.S. PATENT DOCUMENTS 3,964,070 A * 6/1976 Drabowitch ..... H01Q 25/02 343/786
4,897,664 A * 1/1990 Killackey ..... H01Q 1/28 343/789
5,736,907 A * 4/1998 Chen ..... H01Q 25/04 333/113
7,038,620 B1 * 5/2006 Chubb, Jr. ..... H01Q 25/02 342/153
8,686,918 B1 * 4/2014 Diaz ..... H01Q 1/364 343/742

OTHER PUBLICATIONS

W. Kocanda et al., Direction finding device with quasi-circular antenna array, 14th International Conference on Microwaves, Radar and Wireless Communications, p. 67-70, 2002.*

(Continued)

*Primary Examiner* — Bernarr E Gregory
*Assistant Examiner* — Fred H Mull
(74) *Attorney, Agent, or Firm* — Sung T. Kim

(57) ABSTRACT

A method including receiving a monopulse transmission by a monopulse antenna determining an angle of arrival of the monopulse transmission, using processing circuitry operably coupled to the monopulse antenna, determining, using the processing circuitry, an angle error for a high gain antenna based on the angle of arrival of the monopulse transmission, and causing the positioning of the high gain antenna based on the angle error.

19 Claims, 16 Drawing Sheets

(56) References Cited

OTHER PUBLICATIONS

A. Brown et al., Locating the Jammer using A/J Software Receiver, ION GNSS International Technical Meeting of the Satellite Division, p. 110-121, Sep. 2004.*
S.D. Slobin et al.,34-m BWG Stations Telecommunications Interfaces, 104, Rev. C, in DSMS Telecommunications Link Design Handbook, 810-005, Rev. E, Sep. 2008.*
M.I. Skolnik, Radar Handbook, Third Edition, Chapter 9: Tracking Radar, McGraw-Hill Professional, 2008.*
D.J. Copeland et al., The APL 18.3m Station Upgrade and Its Application to Lunar Missions, IEEE Aerospace Conference, p. 1-10, 2010.*
L.L. Monte et al., Rediscovering Monopulse Radar with Digital Sum-Difference Beamforming, IEEE Antennas and Propagation Society International Symposium, p. 1-2, 2012.*
Definition of monopulse radar or monopulse tracking. (1992). Academic Press Dictionary of Science and Technology (4th ed.). Oxford, UK: Elsevier Science & Technology. Retrieved from https://search.credoreference.com/content/entry/apdst/monopulse_radar_or_monopulse_tracking/0 (Year: 1992).*

* cited by examiner

| Attenuation (dB) | Corresponding angle off boresight (mrad) |
|---|---|
| 0 | 0 |
| 0.07 | 0.04 |
| 0.16 | 0.09 |
| 0.36 | 0.21 |
| 0.60 | 0.35 |
| 0.93 | 0.54 |
| 1.47 | 0.85 |
| 2.34 | 1.34 |
| 3.72 | 2.09 |

MONOPULSE AUTOTRACKING SYSTEM FOR HIGH GAIN ANTENNA POINTING

CROSS REFERENCE TO RELATED APPLICATIONS

This application claims the benefit of U.S. Provisional Application No. 62/067,530 filed on Oct. 23, 2014, the entire contents of which are hereby incorporated herein by reference.

STATEMENT REGARDING FEDERALLY SPONSORED RESEARCH OR DEVELOPMENT

This invention was made with U.S. Government support under contract number 1326365 awarded by the National Aeronautics and Space Administration. The Government has certain rights in the invention.

TECHNICAL FIELD

Example embodiments generally relate to high gain antenna pointing and, in particular, relate to a monopulse autotracking system for high gain antenna pointing.

BACKGROUND

High data rate satellite communication relies on the ability to accurately point a high gain antenna (HGA). HGA pointing is typically controlled by either the satellite's attitude control system (ACS), or by a combination of the ACS and a parallel feedback control system in instances in which the antenna is gimbaled. In both cases, the pointing control system receives attitude information from a variety of sensors, such as Stellar Reference Units (SRU). Based on the input form these sensors, the pointing control system controls spacecraft actuators, such as reaction wheels or gimbals. Antennas with very high gain, such as Ka band (~32 GHz) antennas may have a very small beamwidth. For example, an antenna with >58 dB gain will have a 3 dB beamwidth <0.21°. System designers often strive to keep pointing loss less than 1 dB for a high data rate link, hence the pointing requirement may be very narrow, such as <0.06°. Such a narrow pointing requirement is difficult to meet with only SRU input. The gain of the HGA may be significantly reduced due to a pointing angle error. FIG. 5 illustrates the change in gain and data rate for a change in pointing angle error for an example HGA.

BRIEF SUMMARY OF SOME EXAMPLES

Accordingly, some example embodiments may enable the provision of a monopulse autotracking system for high gain antenna pointing, as described below. In an example embodiment, a system is provided including a high gain antenna, a monopulse antenna for receiving a monopulse transmission, processing circuitry operably coupled to the monopulse antenna and configured for determining an angle of arrival of the monopulse transmission, determining an angle error for the high gain antenna based on the angle of arrival of the monopulse transmission, and causing the positioning of the high gain antenna based on the angle error.

In another example embodiment, a method is provided including receiving a monopulse transmission by a monopulse antenna, determining an angle of arrival of the monopulse transmission, using processing circuitry operably coupled to the monopulse antenna, determining, using the processing circuitry, an angle error for a high gain antenna based on the angle of arrival of the monopulse transmission, and causing the positioning of the high gain antenna based on the angle error.

BRIEF DESCRIPTION OF THE SEVERAL VIEWS OF THE DRAWING(S)

Having thus described the a monopulse autotracking system for high gain antenna pointing in general terms, reference will now be made to the accompanying drawings, which are not necessarily drawn to scale, and wherein:

DETAILED DESCRIPTION

Figure 1:
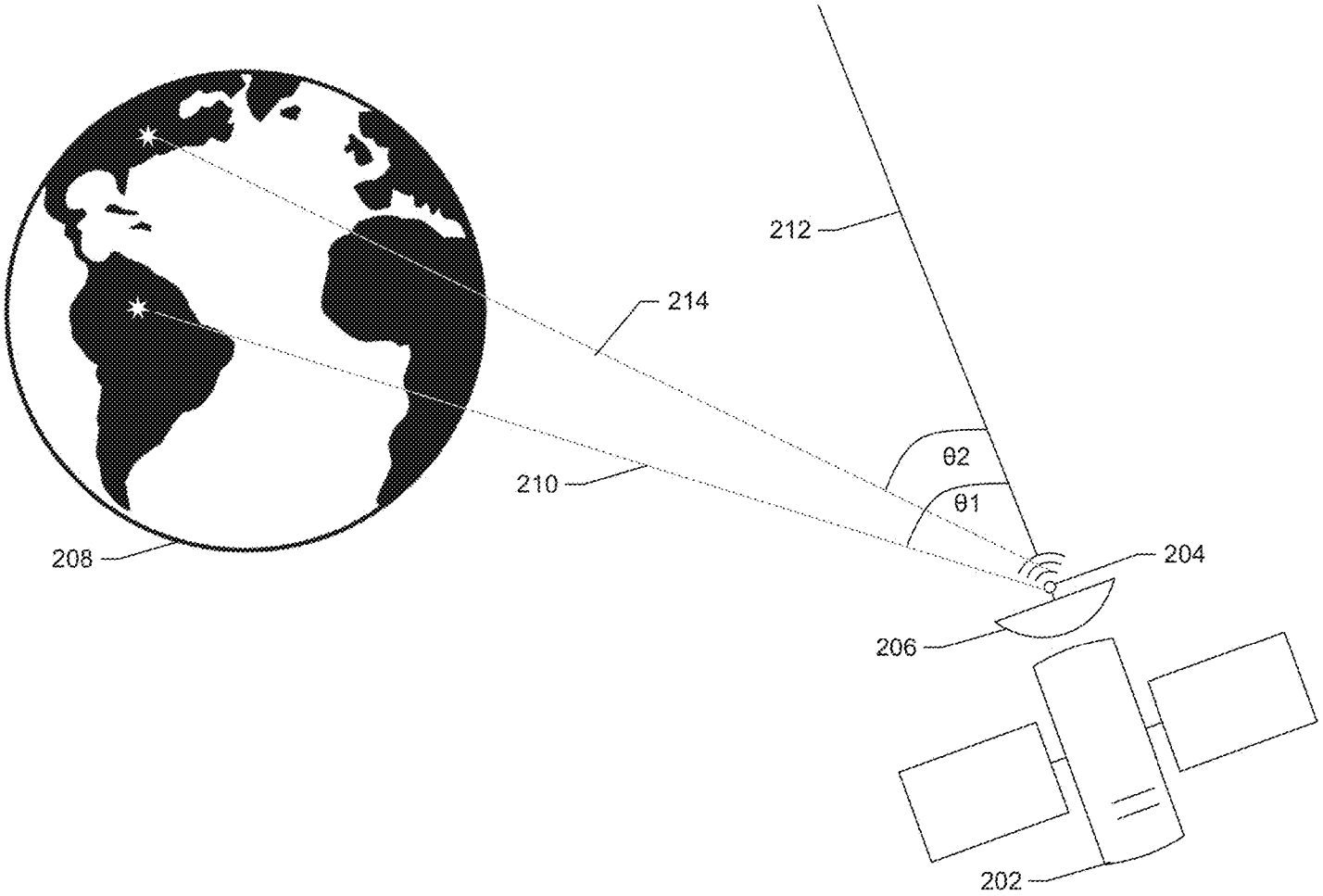
FIG. 1 illustrates a high gain antenna deployed on a spacecraft according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

As used in herein, the terms "component," "module," and the like are intended to include a computer-related entity, such as but not limited to hardware, firmware, or a combination of hardware and software. For example, a component or module may be, but is not limited to being, a process running on a processor, a processor, an object, an executable, a thread of execution, and/or a computer. By way of example, both an application running on a computing device and/or the computing device can be a component or module. One or more components or modules can reside within a process and/or thread of execution and a component/module may be localized on one computer and/or distributed between two or more computers. In addition, these components can execute from various computer readable media having various data structures stored thereon. The components may communicate by way of local and/or remote processes such as in accordance with a signal having one or more data packets, such as data from one component/module interacting with another component/module in a local system, distributed system, and/or across a network such as the Internet with other systems by way of the signal. Each respective component/module may perform one or more functions that will be described in greater detail herein. However, it should be appreciated that although this example is described in terms of separate modules corresponding to various functions performed, some examples may not necessarily utilize modular architectures for employment of the respective different functions. Thus, for example, code may be shared between different modules, or the processing circuitry itself may be configured to perform all of the functions described as being associated with the components/modules described herein. Furthermore, in the context of this disclosure, the term "module" should not be understood as a nonce word to identify any generic means for performing functionalities of the respective modules. Instead, the term "module" should be understood to be a modular component that is specifically configured in, or can be operably coupled to, the processing circuitry to modify the behavior and/or capability of the processing circuitry based on the hardware and/or software that is added to or otherwise operably coupled to the processing circuitry to configure the processing circuitry accordingly.

As used herein the term "monopulse transmission" is intended to refer to radio frequency (RF) transmissions used by a monopulse receiver. However, a monopulse transmission is not necessarily dedicated to monopulse and may contain other data, including, without limitation, telecommunications data.

In some example embodiments, a monopulse autotrack system (MAS) may be used to assist the pointing of the HGA on a spacecraft. The MAS may receive a monopulse transmission and determine, e.g. estimate, angle of arrival (AOA) and determine an angle error of the HGA. The MAS may cause the HGA to be positioned to a desired direction based on the angle error.

In some examples, the monopulse transmission may be an X-band uplink, such as a terrestrial command uplink to the spacecraft. The HGA may be a Ka-band downlink, such as for data downlink from the spacecraft.

The MAS may include one or more monopulse antennas configured with phase or amplitude sensors. The MAS may utilize a software defined radio (SDR) instead of, or in addition to, traditional passive RF components for digital carrier recovery, which may provide accurate and flexible phase tracking capabilities. In some example embodiments, the MAS may provide pointing estimates with a RMS error less than 0.01 degrees with receive power levels as low as or lower than −150 dBm.

The implementation of the MAS utilizing a SDR may allow for significant antenna design flexibility, for example 3 element and 4 element systems may be used with flexible antenna spacing, e.g. not necessarily equal or orthogonal. Further, the MAS may operate both as a closed loop autotrack system and as an open-loop calibration system where absolute angle estimates are required, and can reuse hardware that supports radio functionality, e.g. telecommunications.

Example Monopulse Tracking System

An example embodiment of the monopulse autotracking system for HGA pointing will now be described in reference to FIG. 1. FIG. 1 illustrates a HGA 206 deployed on a space craft 202. A monopulse antenna 204 may also be deployed on the spacecraft 202. In an example embodiment, the monopulse antenna 204 may be operably coupled to or integrated into the HGA 206, as depicted in FIG. 1 and discussed below in reference to FIG. 4. Additionally or alternatively, the monopulse antenna 204 may be operably coupled to various portions of the spacecraft 202, such as corners or ends of the spacecraft 202.

In an example embodiment, the monopulse antenna 204 may receive a monopulse transmission 210. In some example embodiments, the monopulse transmission 210 may originate from a terrestrial transmitter. In an example embodiment, the monopulse antenna 204 may include a monopulse phase sensor and/or a monopulse amplitude sensor configured to measure a monopulse amplitude and/or phase. The monopulse antenna 204 may provide the monopulse amplitude and/or phase measurements to the MAS for analysis. The MAS may determine an Angle of Arrival (AOA). The AOA $\theta 1$ may be the difference between the direction at which the monopulse transmission 210 was received and a current pointing direction 212 of the HGA 206.

The MAS may determine an estimated angle error $\theta 2$. The estimated angle error $\theta 2$ may be the difference between the current pointing direction 212 of the HGA 206 and the desired transmission or reception direction 214. In some example embodiments, the desired transmission or reception direction 214 may be the same as the direction at which the monopulse transmission 210 was received, e.g. AOA, in such an instance $\theta 1=\theta 2$.

In an example embodiment, such as in an instance in which the spacecraft 202 is utilized for a deep space mission, $\theta 1$ may not equal $\theta 2$, due to a 2 way light time. The space craft AOA $\theta 1$ determination may be stale by one way light time, potentially hours. The determination of the angle error $\theta 2$ may compensate for the 1 way light of the down link, from the HGA 206 to earth.

The MAS may cause the positioning of the HGA 206, e.g. alignment with the desired transmission or reception direction 214, based on the estimates angle error $\theta 2$. In an example embodiment, the MAS may be configured to control spacecraft actuators, such as reaction wheels or gimbals. In an example embodiment, the MAS may output the angle error to an ACS for positioning of the HGA 206, by controlling the spacecraft actuators.

In an example embodiment, the monopulse transmission 210 may be an X-band transmission. In some example embodiments, the monopulse transmission 210 may be a command uplink for the spacecraft 202. In an example embodiment, the HGA 206 may be configured for transmission or reception in the Ka-band. In some example embodiments, the HGA 206 may be configured for a data downlink, such as a downlink to a terrestrial receiver. Although the monopulse antenna 204 is discussed as being configured for X band and the HGA 206 is discussed as being configured for Ka band, it would be immediately understood by one of ordinary skill in the art that other RF bands may be used for the monopulse antenna 204, the HGA 206, or both.

As discussed the monopulse antenna 204 may be a phase and/or amplitude monopulse antenna. The antenna configuration, of the HGA 206, may dictate which type of monopulse antenna 204 may be utilized or if both types may be utilized. An HGA 206 may use phase monopulse antennas 204 with spatially diverse phase centers, or an HGA 206 may use amplitude monopulse antennas 204 with narrow beamwidths that are squinted with respect to each other. Some HGA antenna configurations may allow for both an amplitude and a phase monopulse antenna 204 to be utilized in the same antenna configuration, for example the HGA 206 discussed in reference to FIG. 3.

Figure 2A:
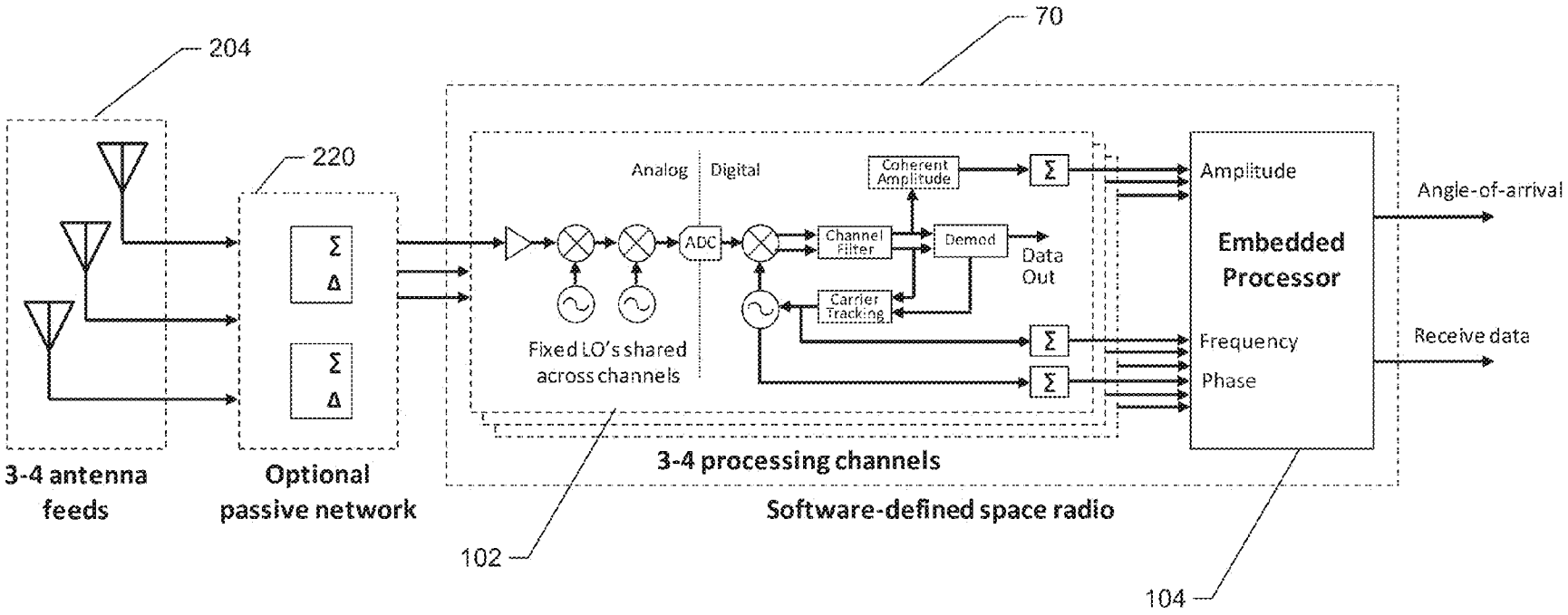
FIG. 2A illustrates an example software defined radio according to an example embodiment.

FIG. 2A illustrates an example SDR 70 according to an example embodiment. The SDR 70 may receive a monopulse transmission from the monopulse antenna 204. The monopulse antenna 204 may include 3 elements, 4 elements, or the like. In an example embodiment, the monopulse antenna 204 may include two pairs of orthogonal feed elements. Alternatively, the monopulse antenna may include three or more non-orthogonal feed elements. Each element of the monopulse antenna 204 may provide an antenna feed to the SDR 70. The SDR 70 may determine an AOA of the monopulse transmission 210. In an example embodiment, the SDR 70 may include a processing channel 102 for each antenna feed. The processing channel may be driven directly from a monopulse antenna feed, or by the output of a passive sum or difference element.

The monopulse transmission 210 may be received by a low noise amplifier of the processing channel 102. The amplified monopulse transmission may be received by a mixer or mixers operably coupled to a local oscillator, from the low noise amplifier. The local oscillator may have a fixed frequency. The local oscillator may be shared between the processing channels 102, e.g. the processing channels may be phase coherent. The mixer and local oscillator may perform a frequency conversion, e.g. heterodyning, on the monopulse transmission 210 producing sum and difference frequencies from the frequency of the local oscillator and the input monopulse transmission 210. The mixer may output the sums and differences to an analog to digital converter (ADC).

The ADC may convert analog IF signals to digital IF signals, which may be received by a mixer, which outputs baseband I/Q, based on a numerically controlled oscillator (NCO). The base band may be filtered by a channel filter and sent to a data demodulator for demodulation of data in the monopulse transmission 210. The demodulated data may be output to the user interfaces, command control circuitry, device interfaces, or the like. The base band may also be output to a coherent carrier amplitude module operably coupled to an amplitude summing module which outputs amplitude estimates for each processing channels to an embedded processor 104. The base band I/Q may also be output to a carrier tracker. The carrier tracker may include a carrier phase detector and a carrier frequency loop filter. The carrier tracker may be configured to output frequency data to a NCO and a frequency summing module. The NCO may be configured to output phase data to a phase summing module. The frequency summing module may output frequency data, and the phase summing module may output vector positions of the phase center of each antenna feed to the embedded processor 104.

The embedded processor 104 may determine the angle error for a phase monopulse or amplitude monopulse, as described below. In some example embodiments, the embedded processor 104 may determine the angle error based on both a phase monopulse and an amplitude monopulse. In some such embodiments, the angle errors may validate each, such as by performing a comparison of the angle errors. The angle errors may be valid if the difference between the angle errors is less than a predetermined difference, such as 0.01 degrees, 0.001 degrees, or the like.

In some example, embodiments the embedded processor 104 may be configured to coherently track the command uplink to the spacecraft 202 within a narrow bandwidth to provide an accurate estimate of relative phase and/or amplitude for weak signal conditions. The embedded processor 104 may be configured to calculate the AOA from the relative phase and/or amplitude estimates and the geometry of the monopulse antenna 204. In some example embodiments, the embedded processor 104 may utilize the telecommunications data to assist in the determination of the AOA and/or the determination of the angle error.

Additional or alternatively, a passive RF network 220, including components such as summing and difference circuits, may be operably coupled between the monopulse antenna 204 and the SDR 70. The passive RF network 220 may provide analog sums and differences of the monopulse transmission 210 for analysis by the SDR 70. An example embodiment of the passive RF network 220 may include an amplitude to phase converter, as described below in reference to FIG. 2B.

Phase Monopulse

In an example embodiment, the monopulse antenna 204 may include a three element antenna array with spatially diverse phase centers. The relative phase between the three antenna elements may be tracked using the SDR 70. Based on the relative phase differences, a unique 2-dimensional pointing error, e.g. angle error, may be estimated.

Let $\vec{a}$, $\vec{b}$ and $\vec{c}$ denote the vector positions of the phase centers of three antennas. If a plane wave with wave vector $\hat{k}$ impinges upon this 3-element array, then the phase of the signal at $\vec{b}$ relative to $\vec{a}$ is $$\phi_{ba} = \vec{k}\cdot(\vec{b}-\vec{a}) = \frac{2\pi l_{ba}}{\lambda}\hat{k}\cdot\hat{v}_{ba} \tag{1}$$

where $\hat{k}$ and $\hat{v}_{ba}$ are unit vectors, $\hat{k}=\lambda/2\pi\,\vec{k}$, $\hat{v}_{ba}=(\vec{b}-\vec{a})/l_{ba}$, $\lambda$ is wavelength and $l_{ba}=|\vec{b}-\vec{a}|$. Likewise, let $\phi_{ca}$ be the phase of the signal at $\vec{c}$ relative to $\vec{a}$, and $\hat{v}_{ca}=(\vec{c}-\vec{a})/l_{ca}$. The dot product of the unit vectors are then given by $$\hat{k}\cdot\hat{v}_{ba} = \frac{\lambda\phi_{ba}}{2\pi l_{ba}} = \beta_{ba} \qquad \hat{k}\cdot\hat{v}_{ca} = \frac{\lambda\phi_{ca}}{2\pi l_{ca}} = \beta_{ca} \tag{2}$$

$$\hat{k} = \gamma\frac{\hat{v}_{ba}\times\hat{v}_{ca}}{|\hat{v}_{ba}\times\hat{v}_{ca}|} + \frac{1}{|\hat{v}_{ba}\times\hat{v}_{ca}|^2}\cdot((\beta_{ba}-\beta_{ca}\hat{v}_{ba}\cdot\hat{v}_{ca})\hat{v}_{ba}+(\beta_{ca}-\beta_{ba}\hat{v}_{ba}\cdot\hat{v}_{ca})\hat{v}_{ca}) \tag{3}$$

where $\lambda$ is constrained such that $|\hat{k}|=1$. If $\hat{k}$ is perpendicular to the plane containing $\hat{v}_{ba}$ and $\hat{v}_{ca}$ then the magnitude of the first term in Eq. 3 has unit magnitude and the second term is zero. The solution for $\hat{k}$ can be simplified where the coordinate system is chosen such that the phase centers of the three antennas define a plane normal to one axis. If $\hat{v}_{ba}=[v_x, v_y, 0]^T$ and $\hat{v}_{ca}=[w_y, w_y, 0]^T$, then the solution for $\hat{k}=[k_x, k_y, k_z,]^T$ is given by $$[k_x, k_y]^T = M^{-1}[\beta_{ba}, \beta_{ca}]^T \tag{4}$$

where $$M = \begin{bmatrix} v_x & v_y \\ w_x & w_y \end{bmatrix} \tag{5}$$

and $k_z$, is constrained such that $|\hat{k}|=1$. For the phase monopulse solution, angle errors $\beta_{ba}$ and $\beta_{ca}$ are calculated from the relative phase differences $\phi_{ba}$ and $\phi_{ca}$ assuming perfect knowledge of the wavelength and physical separation between the phase centers. A three-element array provides a unique angle error solution. In some example embodiments, larger arrays, e.g. including more elements may be exploited to improve accuracy using least-squares techniques.

Amplitude Monopulse

In an example embodiment, the monopulse antenna 204 may include an antenna array with coincident phase centers, the receive patterns of each antenna may be tilted with respect to each other. The embedded processor 104 may estimate the angle error from the relative amplitudes. The carrier tracking capability of the SDR 70 may be leveraged to estimate the coherent carrier amplitude received by each antenna, thus estimating amplitude in a more narrow bandwidth than a passive RF power detector. While the amplitude estimate may be performed within a narrow bandwidth, the system may be robust to Doppler shift and oscillator drift because the radio actively tracks the carrier, recentering the amplitude estimator as the received carrier frequency varies over time.

Let A $\exp(j\theta_a)$, B $\exp(j\theta_b)$ and C $\exp(j\theta_c)$ be complex phasors representing the signals from three antennas. Because the phase centers are coincident ($\phi_{ba}=\phi_b-\phi_a=0$ and $\phi_m=0$. The absolute values of A, B, and C may not be significant to the calculation, as A, B, and C are functions of the received signal strength. The ratios of the phasors may be indicative of the angle of incidence. Let G be a vector function that maps the incident vector $\hat{k}$ to the ratio of phasor magnitudes $$[B/A, C/A]^T = G(\hat{k}|\hat{a},\hat{b},\hat{c}) \tag{6}$$

where $\hat{a}$, $\hat{b}$ and $\hat{c}$ are unit vectors representing the boresight direction for each antenna. Hence $\hat{k}$ can be written as $$k = G^{-1}(B/A, C/A|\hat{a},\hat{b},\hat{c}) \tag{7}$$

In general, there is no closed-form expression for $G^{-1}$. Nonetheless, if the antenna patterns are known then $G^{-1}$ can be implemented numerically as a look-up table with two operands, B/A and C/A. The complete solution for $\hat{k}$ again uses the constraint $|\hat{k}|=1$.

Approximate closed form solutions can be derived if the antenna pattern is assumed to be separable and is expressed analytically. For example, suppose the normalized gain of each antenna is given by $$g = e^{-\Gamma\theta^2} \tag{8}$$

where $\Gamma$ is a constant that determines the beamwidth of the antenna and $\theta$ is the angle off boresight. If $\hat{v}_{ba}$ and $\hat{v}_{ca}$ are redefined in terms of boresight vectors rather than phase center vectors then new expressions for $\beta_{ba}$ and $\beta_{ca}$, can be derived, and Eq. 3 can be used to solve for k for an amplitude monopulse. Let $\hat{v}_{ba}=(\hat{b}-\hat{a})/l_{ba}$, where $l_{ba}=|\hat{b}-\hat{a}|$, and define $\hat{v}_{ca}$. in a similar manner Solving for $\beta_{ba}$ yields $$\begin{aligned} \beta_{ba} &= \hat{k}\cdot\hat{v}_{ba} \\ &= \frac{\hat{k}\cdot\hat{a}}{l_{ba}} - \frac{\hat{k}\cdot\hat{b}}{l_{ba}} \\ &\approx \frac{\cos\sqrt{-\log(B^2)/\Gamma}}{l_{ba}} - \frac{\cos\sqrt{-\log(A^2)/\Gamma}}{l_{ba}} \end{aligned} \tag{9}$$

And similarly for $\beta_{ca}$. Note that these expressions require knowledge of A, B and C rather than only the ratios B/A and C/A. In an example embodiment, an automatic gain control (AGC) may be used to set the total receive power and thus provide a mapping from power ratios to absolute power.

Figure 2B:
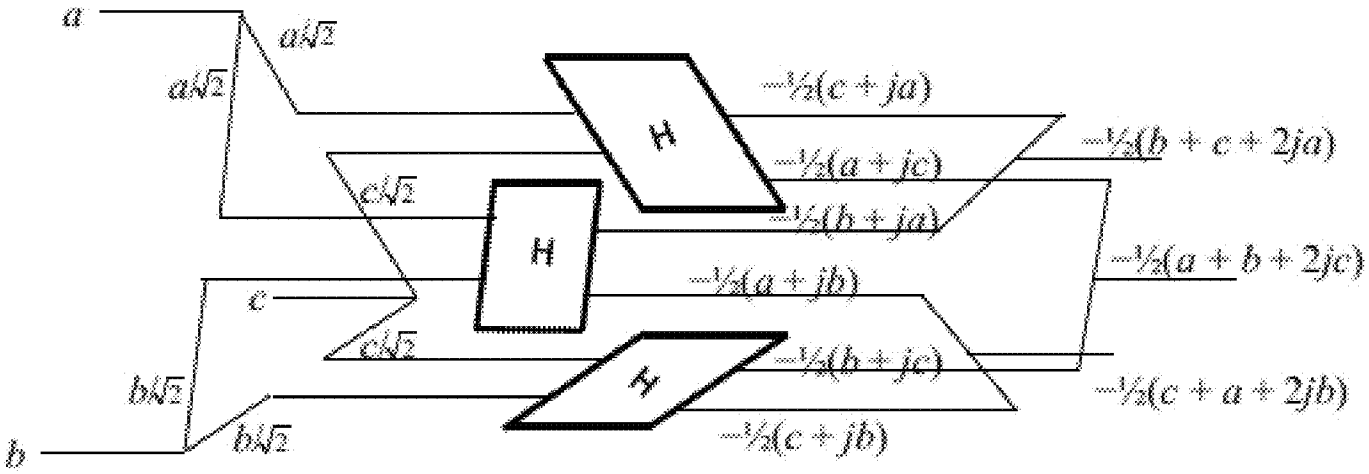
FIG. 2B illustrates an example amplitude to phase converter according to an example embodiment.

FIG. 2B illustrates an example amplitude to phase converter according to an example embodiment. A conventional monopulse network may be configured to operate with 4 feeds arranged in a two dimensional square array that provides estimate of angle errors off boresight along two mutually orthogonal directions. Although, a conventional array uses 4 feeds, monopulse processing may be performed using 3 signals for a complete determination of angle errors. Digital processing load may be reduced by utilizing 3 channels for angle error determinations instead of the conventional 4 channels. Additionally, coherent radio receivers, including the monopulse receiver, may be inherently capable of accurately tracking and estimating carrier phase in order to demodulate telecommunications data. However, a phase-comparison monopulse antenna feed may be difficult to realize. In an example embodiment, an amplitude-comparison antenna feed may not utilize the monopulse receiver strength at phase estimation, therefore the signals of an amplitude comparator may not be converted into corresponding phases in a manner that yields a large phase change for a small amplitude change, and preserves good SNR in all receivers so that the phases can be measured accurately.

Assuming that a, b, and c denote the amplitudes of signals that emerge from 3 feeds of an amplitude-comparison monopulse feed. For an ideal feed network all signals have a common phase center and hence there is no relative phase difference between any of them. FIG. 2B shows the arrangement of a passive RF network 220 including an amplitude to phase converter. Each signal undergoes a equal amplitude, equal phase split. The six signals are connected in cyclic pairs to the inputs of a 90° hybrid designated as "H". There are six output signals from the hybrids which are of the form, $-\frac{1}{2}(a+jb)$, $-\frac{1}{2}(b+ja)$, $-\frac{1}{2}(b+jc)$, $-\frac{1}{2}(c+jb)$, $-\frac{1}{2}(c+ja)$, and $-\frac{1}{2}(a+jc)$, which are summed cyclically by two-way 0° combiners to yield output signals, $$s_1=-\tfrac{1}{2}(a+b+2jc); s_2=-\tfrac{1}{2}(b+c+2ja); s_3=-\tfrac{1}{2}(c+a+2jb) \tag{10}$$

Note that the outputs from the converter are linear combinations of all three signals a, b, and c, at least one of which is strong and provides good SNR for the associated receiver to develop a good phase estimate. The phase estimates are $$\phi_1 - \arg(s_1) = \tan^{-1}\frac{2c}{a+b}; \tag{11}$$

-continued $$\phi_2 - \arg(s_2) = \tan^{-1}\frac{2a}{b+c};$$

$$\phi_3 - \arg(s_3) = \tan^{-1}\frac{2b}{c+a}$$

If the target is on the antenna's boresight, then a=b=c, and hence $\phi_1=\phi_2=\phi_3=45°$. If the target is off boresight but on the bisector of feed signals a and b, then a=b>>c, then $\phi_1\approx 0°$, $\phi_2=\phi_3\approx \tan^{-1}2=63.43°$. Lastly, if the target is on the boresight of the beam that corresponds to signal a, then a>>b=c, and $\phi_1=\phi_3\approx 0°$, $\phi_2\approx 90°$.

The greatest sensitivity is obtained by optimizing the patterns of the individual beams in the monopulse triad to produce high enough signal strength on boresight with pattern roll-off away from the boresight position. This may be achieved by adjusting the feed aperture and tilt so that boresight corresponds to the −4.77 dB position on each individual pattern. Amplitude roll-off is more rapid at the −4.77 dB position than at the customary −3.01 dB beamwidth point. This may be achieved by having all three patterns emerge from a common phase center.

The utilization of the amplitude to phase converters may eliminate a need of one receiver from the conventional 4-port monopulse, leverage the advantage of digital radios for estimating and tracking carrier phase, and maintain high a SNR in each receiver channel over all pointing directions so that accurate phase estimates may be made regardless of angle error off-boresight of the desired transmission direction.

Figure 3:
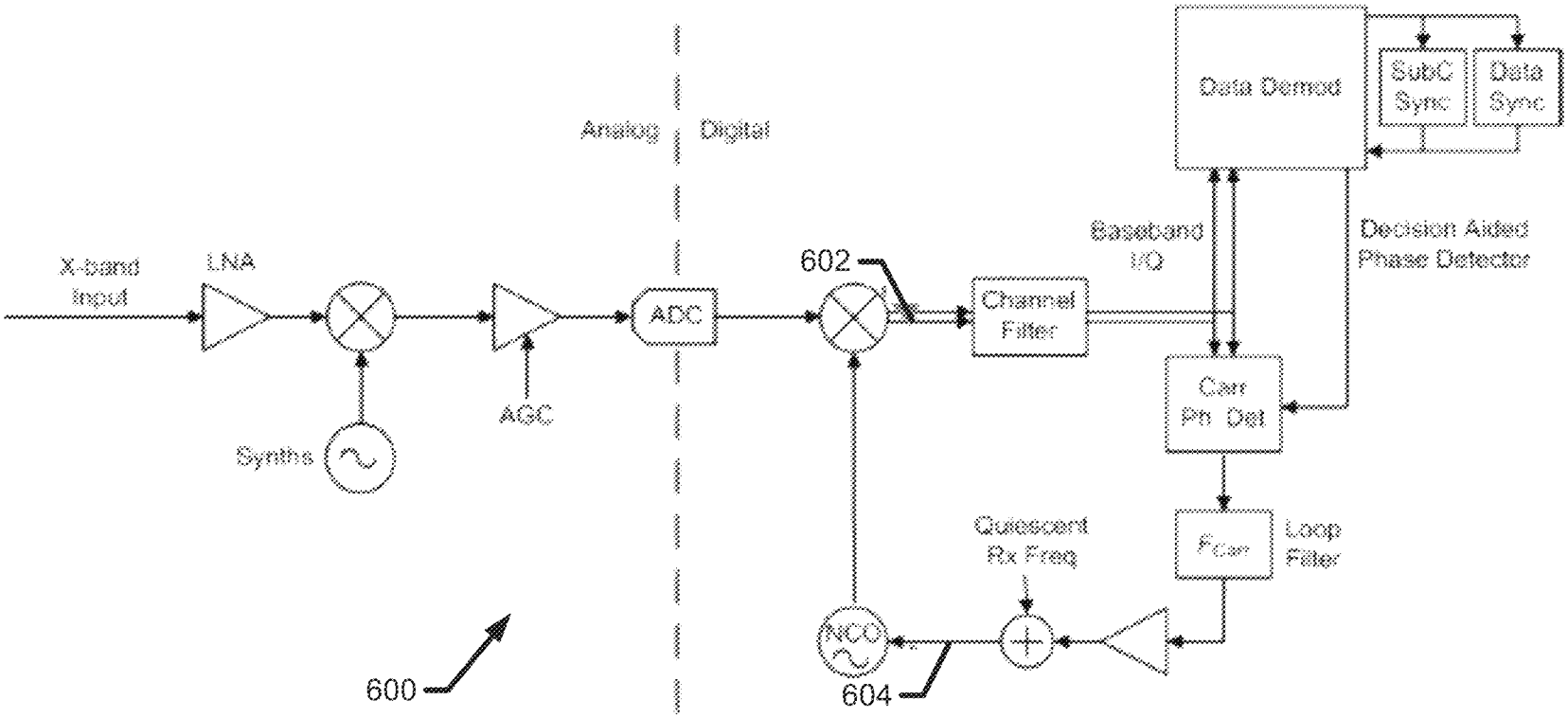
FIG. 3 illustrates a monopulse discriminator according to an example embodiment.

FIG. 3 illustrates a monopulse discriminator 600 according to an example embodiment. The monopulse discriminator 600 may be a portion of the SDR 70, as discussed in reference to FIG. 2. The monopulse discriminator 600 may track the monopulse transmission 210, e.g. uplink signal using a permutation of the last layer (PPL algorithm). In some examples, the estimates of the phase/amplitude may be within a narrow bandwidth, such as 1-100 Hz. The narrow bandwidth tracking may be performed in even in instances in which there are large Doppler dynamics by utilizing Doppler compensation, $3^{rd}$ order loop to track Doppler dynamics, or the like. In an example embodiment, the phase and/or amplitude of the may be tracked when the carrier is suppressed.

In some example embodiments, the monopulse discriminator 600 may use in-phase coherent carrier amplitude 602 for the amplitude monopulse. In an example embodiment, the monopulse discriminator 600 may use a regenerated carrier phase 604 for the phase monopulse.

Example HGA with Integrated Monopulse Antennae

Figure 4:
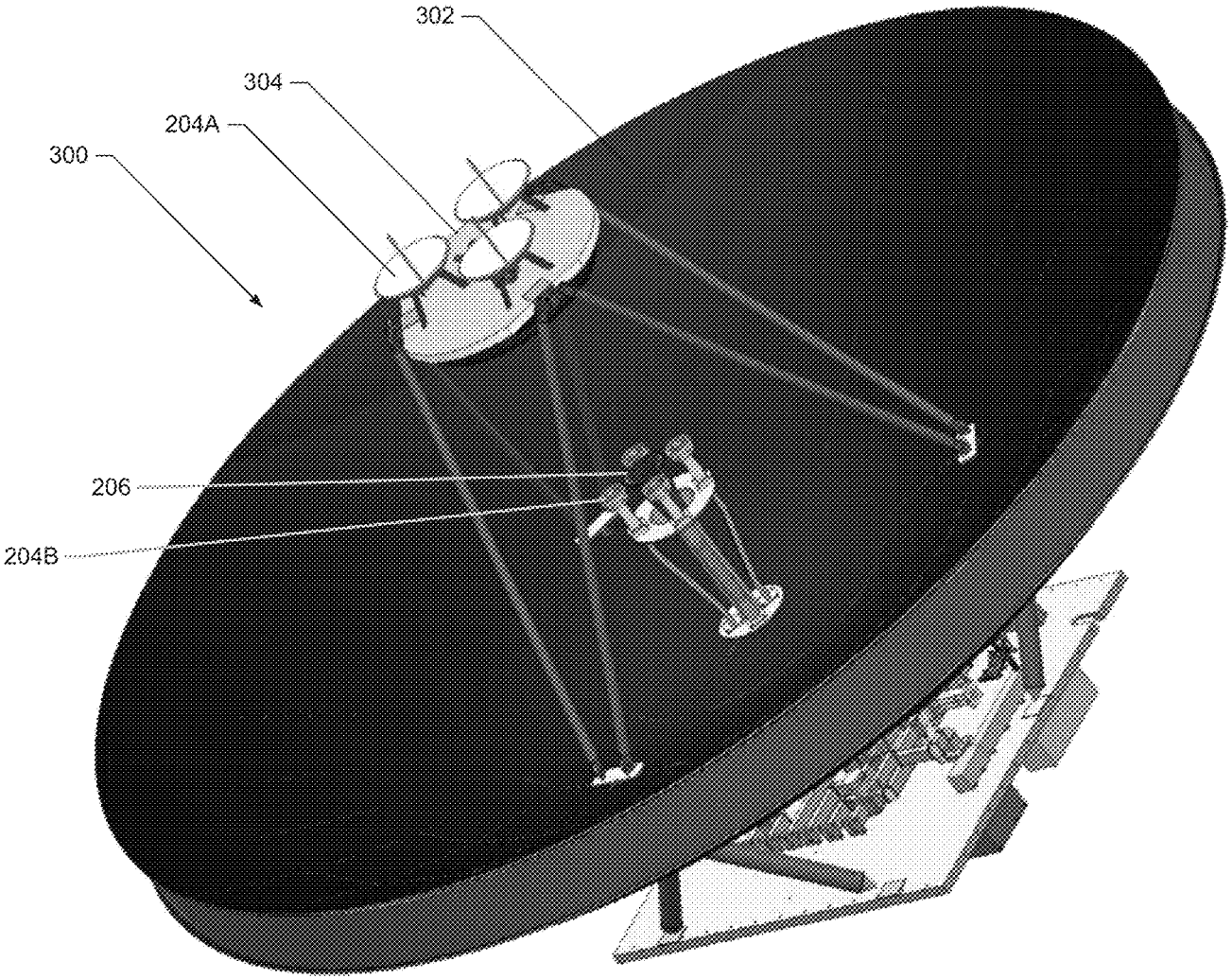
FIG. 4 illustrates an example high gain antenna with integrated monopulse antennas according to an example embodiment.
Figure 5:
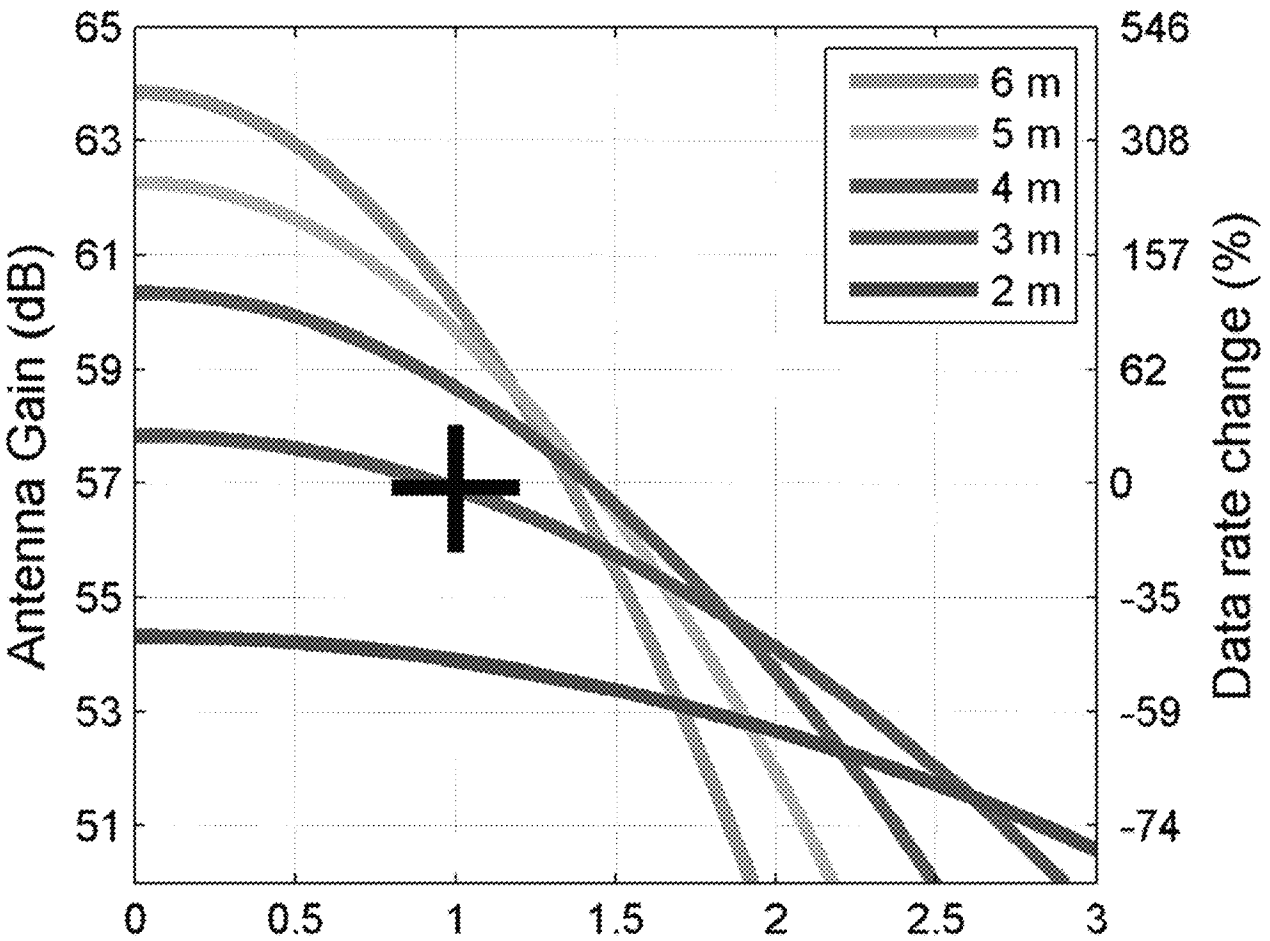
Figure 5 Prior Art
FIG. 5 illustrates antenna gain and data rate change due to pointing error according to an example embodiment.

FIG. 4 illustrates an example high gain antenna 300 with integrated monopulse antennae 204 according to an example embodiment. The antenna 300 includes a 3 m main reflector 302, a 0.6 m sub-reflector 304, and a dual-band X/Ka array feed. The antenna provides receive and transmit capability at X-band and Ka-band. The peak Ka-band gain is approximately 58 dB and the 3 dB beamwidth is approximately 0.21°. A phase monopulse antenna 204A is formed by three medium gain antennas on the subreflector 304. An amplitude monopulse antenna 204B is formed by four horns on the primary HGA 206.

Figure 9:
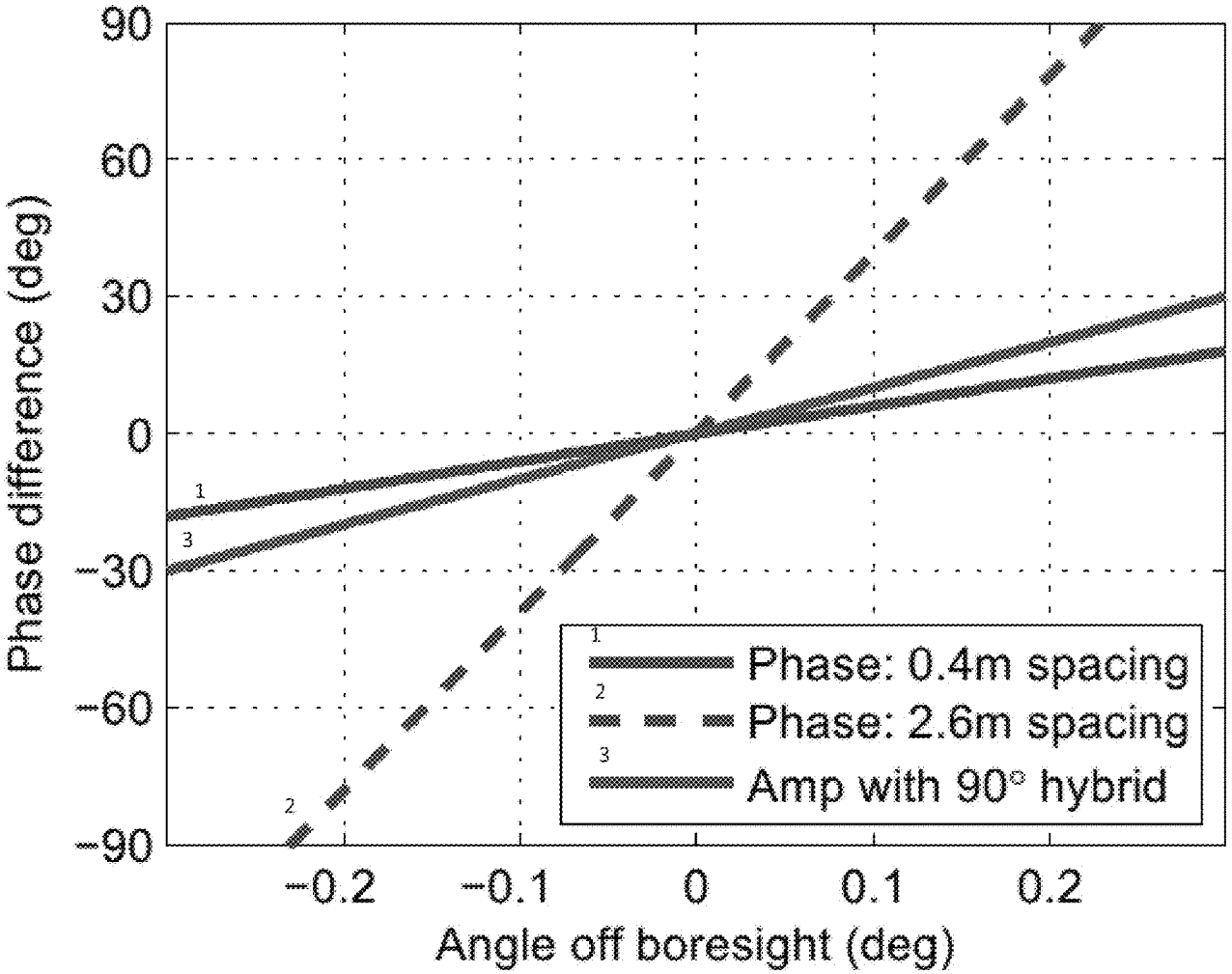
FIG. 9 illustrates sensitivity of monopulse configurations according to example embodiments.

In an example embodiment of the phase monopulse antenna 204A the three medium-gain antennas arranged on the subreflector 304 in an equilateral triangle with edge lengths of 0.4 m. In another example embodiment of the phase monopulse antenna 204A, the three medium-gain antennas are arranged around the perimeter of the main reflector 302, forming an equilateral triangle with edge lengths of 2.6 m. The one-dimensional phase sensitivity curves for these separations are shown in FIG. 9. For example, a pointing error of 0.05° results in a 3.0° phase difference between the two outputs for the 0.4 m configuration, and a 19.6° phase difference for the 2.6 m configuration. The higher phase sensitivity of the 2.6 m configuration yields lower RMS error when noise is added to the model.

Figure 8:
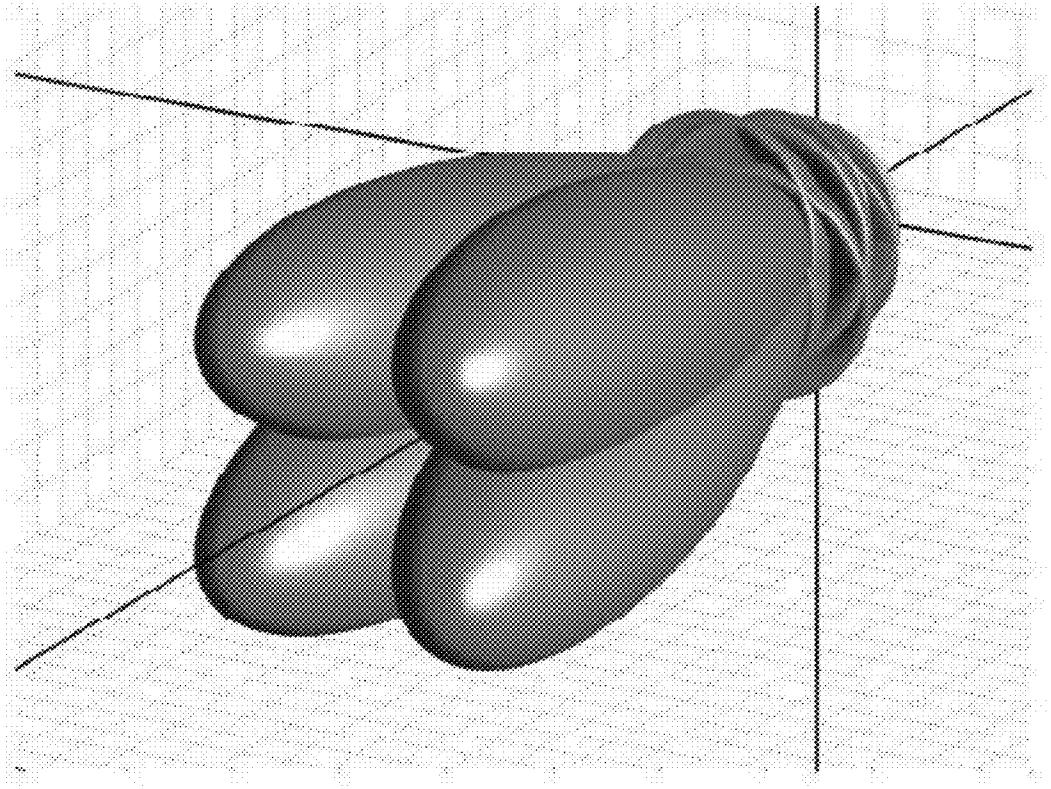
FIG. 8 illustrates an antenna pattern of an amplitude monopulse antenna according to an example embodiment.

The amplitude monopulse antenna 204B is implemented from the four X-band feeds in the HGA 206. The four feeds provide adequate dual-band performance and provide sufficient amplitude sensitivity to provide good monopulse performance. The 3 dB beamwidth of each feed is about 0.9° and is tilted about 0.35° away from the boresight. The combined antenna pattern is shown in FIG. 8. Angle error is estimated by measuring the power difference between opposite pairs of feeds, and using a 2D lookup table to implement $G^{-1}$. For example, if $\hat{k}$ is perfectly aligned with one pair of feeds and tilted 0.05° for the other pair, then the power difference will be zero and 1.6 dB, respectively. The monopulse discriminator in this case detects amplitude differences directly, but performance relative to the phase monopulse systems can be predicted by generating a quadrature phase shift, such as by using 90° hybrid couplers to convert amplitude differences to phase differences. In this case, the phase sensitivity of the amplitude monopulse can be plotted and is shown in FIG. 9.

In the present example, a single carrier loop design is applied for all conditions, including amplitude monopulse. The loop is implemented entirely in the digital domain, including a direct digital synthesizer (DDS) that generates the recovered carrier. Therefore, the phase difference between antenna elements may be measured directly from the phase difference between DDS channels. A critically-damped 2nd-order loop with a 2-sided bandwidth of 24 Hz tracks the carrier of each antenna element, after a down-conversion and gain control. The thermal noise floor, of the present example, is −171 dBm/Hz. For power levels greater than −150 dBm the loop is narrow enough to provide a good reference with which to estimate phase differences. At −150 dBm the loop yields approximately 18° RMS phase error. When the loop itself experiences significant phase noise, then additional filtering is applied to improve the pointing estimate.

Figure 6:
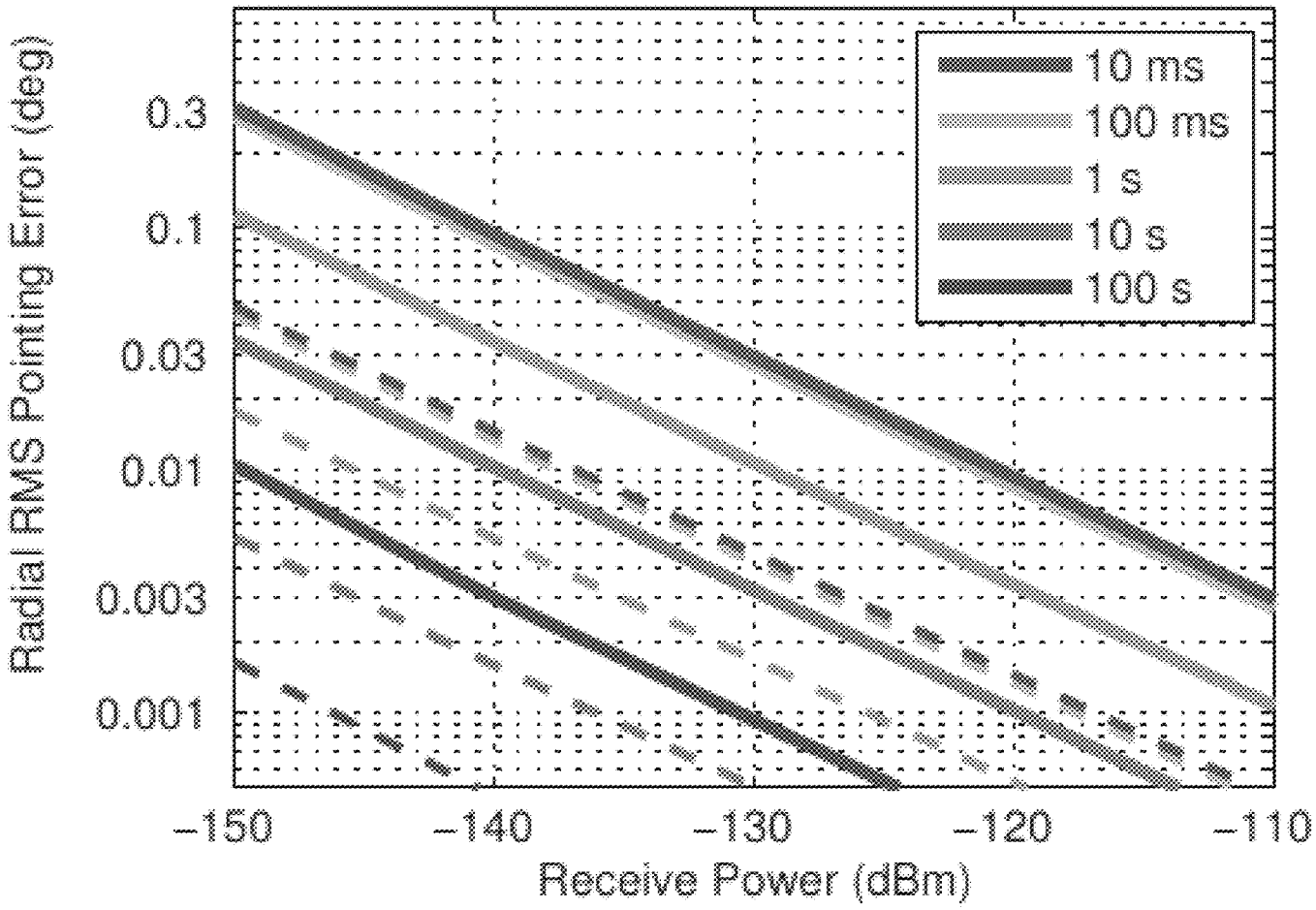
FIG. 6 illustrates performance of a phase monopulse antenna according to an example embodiment.

The performance of the example embodiments of the phase monopulse systems, described above, is illustrated in FIG. 6. The abscissa shows receive power level and the ordinate shows the radial RMS error between the true incident angle $\hat{k}$ and the estimate $\tilde{k}$. The RMS error is inversely proportional to both the integration time and the received power level. The solid lines show the performance of the configuration with the three antennas located on the sub-reflector, and the dashed lines show the performance of the configuration with the three antennas located around the perimeter of the main reflector. The RMS error is inversely proportional to antenna spacing.

Using the 0.4 m configuration, an RMS angle error of 0.01° requires 100 s of integration time at −150 dBm. In an example application, the received X-band power level through the medium-gain antennas during a science tour may be between −140 dBm and −130 dBm. Hence integration times between 1 s and 10 s are required to achieve 0.01°

RMS angle error. For the 2.6 m configuration the required integration time decreases to a range of about 20 ms to 200 ms.

Figure 7:
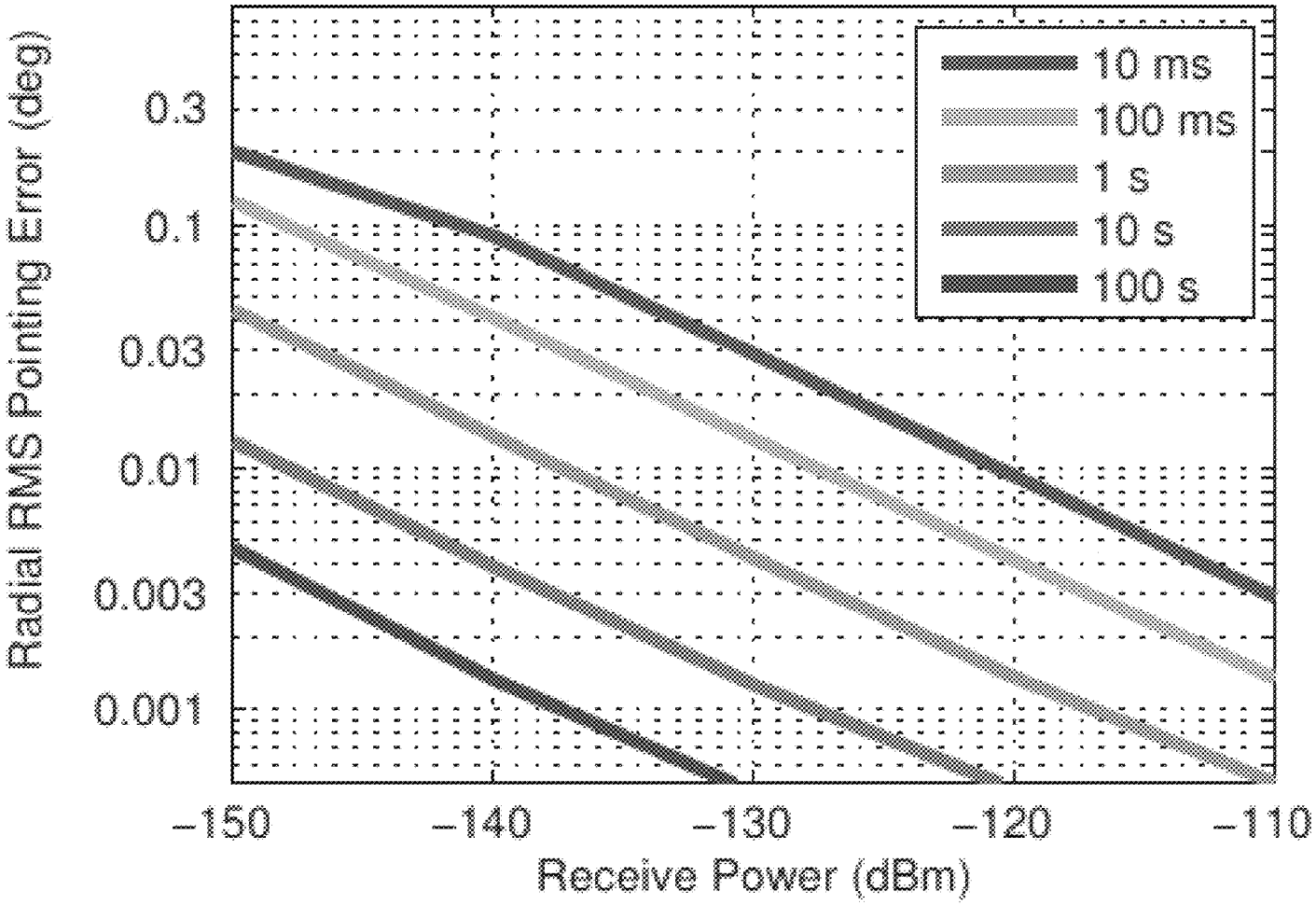
FIG. 7 illustrates performance of an amplitude monopulse antenna according to an example embodiment.

The performance of the example amplitude MAS, discussed above, is shown in FIG. 7. For a fixed receive power level, the performance is better than that of the 0.4 m phase monopulse antenna 204B, but worse than that of the 2.6 m phase monopulse antenna 204A. However, the amplitude monopulse has the advantage of using the HGA 206. Hence the receive power level is approximately 25 dB higher than the medium gain implementation. In an example application, the received X-band power level through the HGA 206 will be between −115 dBm and −105 dBm. Integration time of 10 ms is more than sufficient to achieve 0.01° RMS angle error. In an example embodiment, at this power level, e.g. −115 dBm to −105 dBm the bandwidth of the carrier tracking loop may be widened to provide faster response time.

The phase and amplitude MASs may be sensitive to different aspects of the system. For example, a phase MAS may be sensitive to the phase center positions of each antenna, with respect to each other and with respect to HGA 206 boresight, but not sensitive to the absolute antenna pattern, aside from the effect on signal to noise ratio in each channel. In contrast, the amplitude MAS may be sensitive to the pattern of each antenna, with respect to each other and with respect to HGA 206 boresight. In some example embodiments, the phase MAS may be sensitive to distortions in the electrical group delay between each phase center and the digitizer, and the amplitude MAS may be sensitive to distortions in gain or each signal path.

Imperfect mechanical and electrical stability of the MAS may bias the angle error estimate. Performance in the presence of practical stability distortions may be an important factor when comparing MAS configurations for various applications. For example, in the two phase monopulse configurations described above, in an ideal case, the 2.6 m phase MAS provides greater accuracy than the 0.4 m phase MAS. However, the 2.6 m configuration may suffer greater degradation due to thermal distortions. A loopback calibration system may remove electrical distortions, but may not detect mechanical distortions. In some example embodiments, an in-flight antenna pattern calibration may be utilized to mitigate mechanical distortions.

In an example embodiment including the phase and/or amplitude MAS, multi-channel receivers often exhibit significant gain distortion, whereas the group delay across channels may be very stable. Thus, the amplitude MAS may suffer greater degradation than the phase MAS. In an example embodiment, the gain distortion may be mitigated by using 90° or 180° hybrid couplers to convert amplitude differences into phase differences between the channels.

In some example embodiments, the amplitude MAS may support a calibration solution that encompasses both mechanical and electrical distortions. In example embodiments in which the amplitude monopulse utilizes an array feed at the base of the main reflector 302, a small calibration antenna may be mounted under the secondary reflector 304 to radiate directly into the feed. A calibration system, including the calibration antenna may be activated before each use, or the calibration signal could be persistent with a small frequency offset. In either case, the calibration system may provide a convenient method of removing most biases associated with mechanical and electrical distortions.

The monopulse sensors may be incorporated into a closed-loop autotrack system, e.g. the MAS. The MAS provides a control signal, based on the determined angle error, which drives a feedback control loop in realtime to minimize angle error of the HGA 206. ACSs for deep space missions may rely on inertial pointing algorithms which accommodate multiple sensors and meet numerous constraints simultaneously.

In an example embodiment, the monopulse sensors may not be incorporated into the real-time pointing algorithm. Instead, the MAS may be operated as a calibration sensor that passively receives the monopulse transmission 210, e.g. the command uplink, and estimates the pointing bias for each contact, e.g. monopulse transmission 210. The ACS may then compensate for this bias during the next monopulse transmission. This approach may simplify implementation, however, sources of angle error that change between contacts may not be tracked.

FIG. 8 illustrates an antenna pattern of an amplitude monopulse antenna according to an example embodiment. In the depicted example, the beamwidth and squint have been exaggerated by a factor of 30 to aid in visualization.

FIG. 9 illustrates sensitivity of monopulse configurations according to example embodiments. Curves 1 and 2 depict the sensitivity of the two phase monopulse configurations, as discussed above: monopulse antennas 204A located on the sub-reflector 304 (Curve 1) and monopulse antennas 204A located around the perimeter of the main reflector 302 (Curve 2). Curve 3 depicts the phase sensitivity of the amplitude monopulse antenna 204B in an instance in which 90° hybrid couplers are used to convert amplitude differences into phase differences.

Figure 10A:
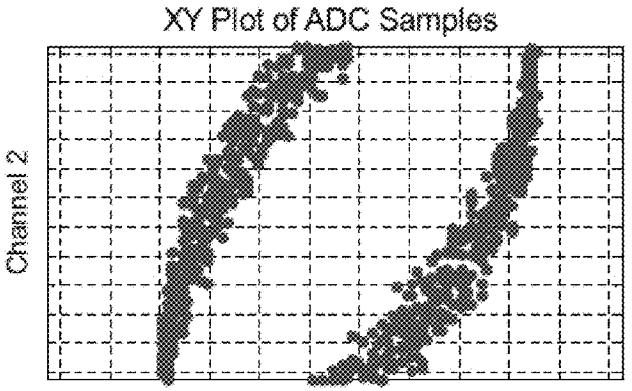
FIGS. 10A-10D illustrate software processing of the monopulse according to an example embodiment.
Figure 10B:
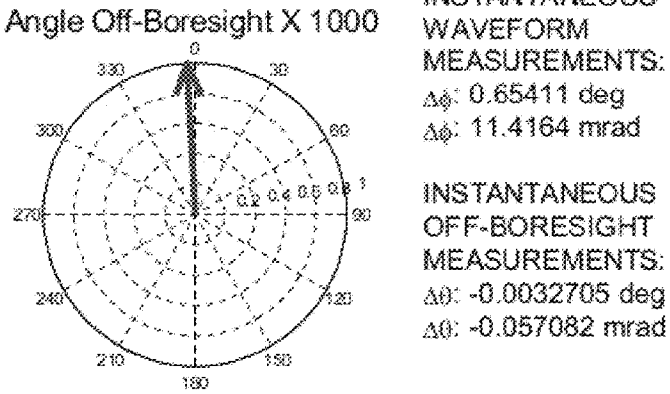
Figure 10C:
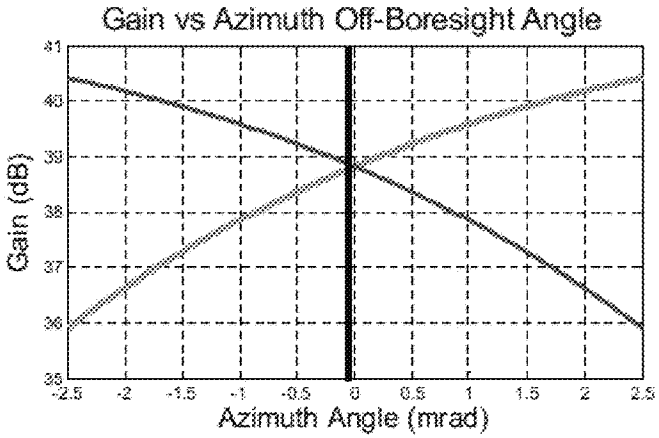
Figure 10D:
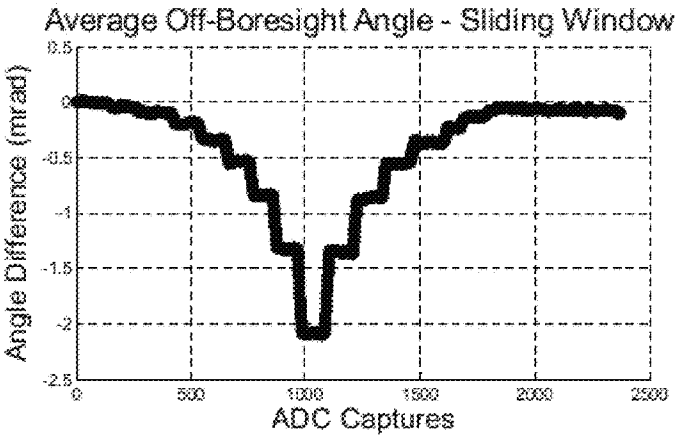

FIGS. 10A-10D illustrate software processing of the monopulse according to an example embodiment of an amplitude MAS. FIG. 10A illustrates an example x,y coordinate plot of ADC samples for channels 1 and 2. FIG. 10B illustrates an example angle off HGA 206 boresight based on instantaneous waveform measurements. FIG. 10C illustrates and example gain for an azimuth off HGA 206 boresight angle for an amplitude monopulse antenna, such as amplitude monopulse antenna 204B. FIG. 10D illustrates an example average off boresight angle sliding window for ADC sample captures.

Figure 11:
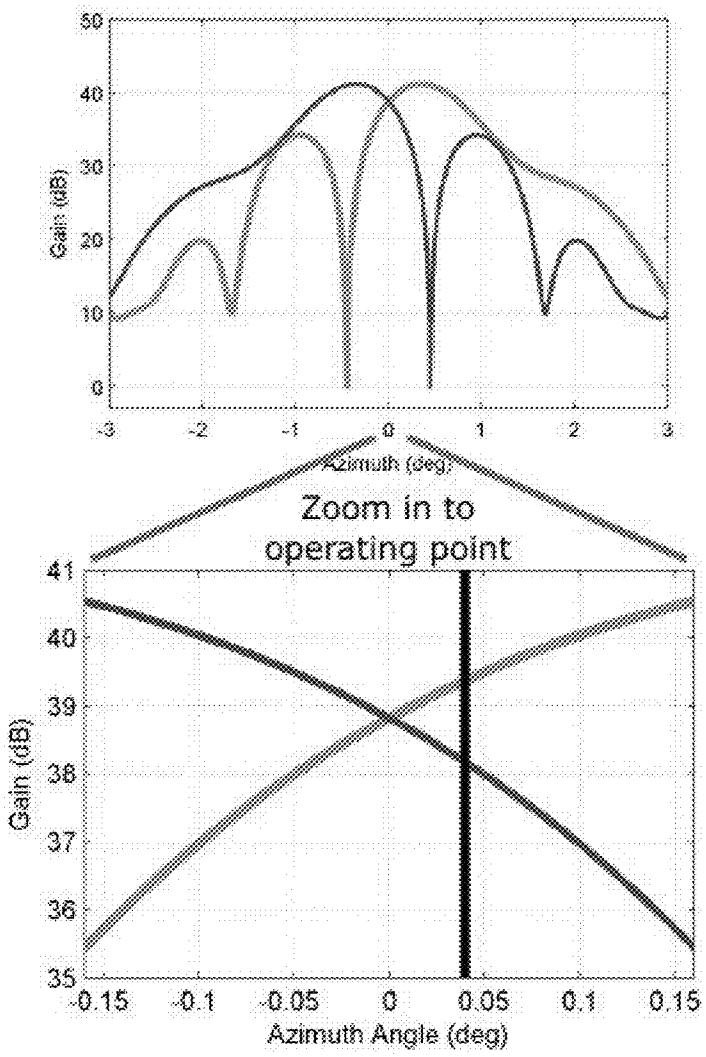
FIG. 11 illustrates antenna gain response based on variance from boresight according to an example embodiment.

FIG. 11 illustrates antenna gain response based on azimuth off HGA 206 boresight angle for an amplitude monopulse antenna, such as amplitude monopulse antenna 204B, according to an example embodiment. The lower graph is a magnification of the upper graph. As depicted, the attenuation increases from 0 dB at 0 mrad off HGA 206 boresight to 3.72 dB at 2.09 mrad off HGA 206 boresight.

Figure 12A:
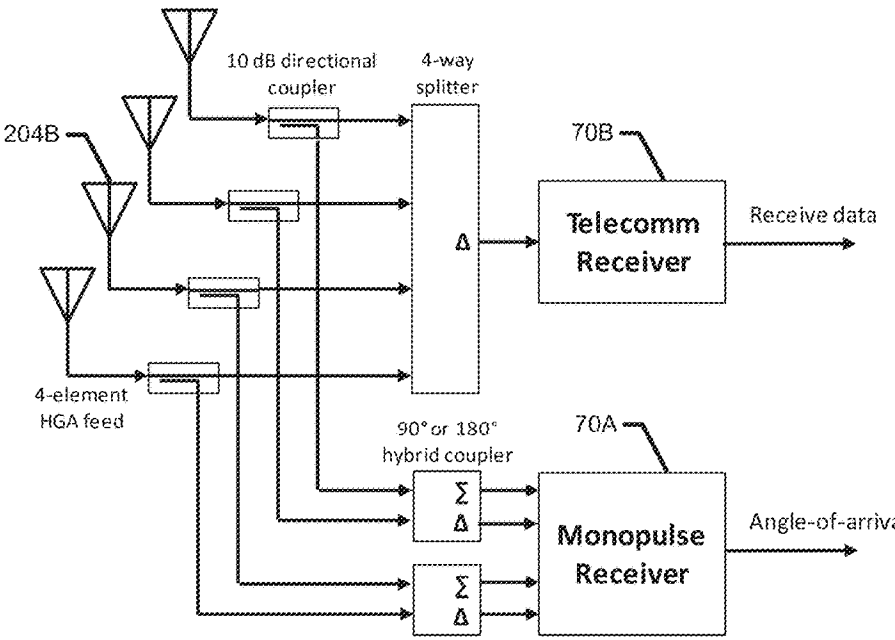
FIGS. 12A and 12B illustrate example amplitude monopulse systems according to an example embodiment.
Figure 12B:
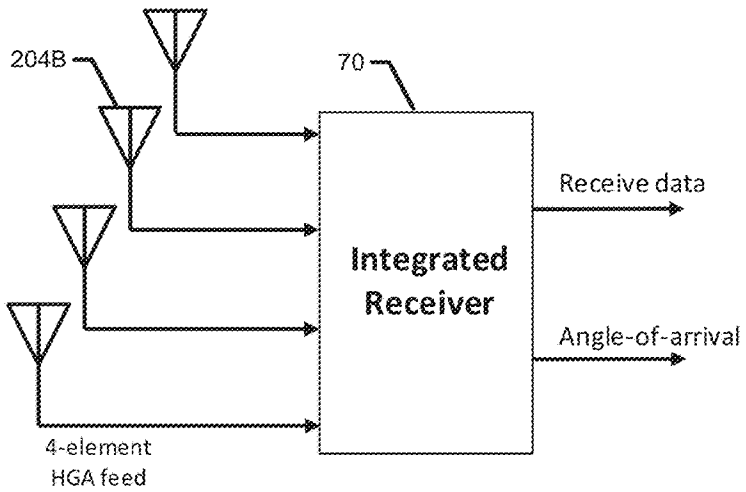

FIG. 12A illustrates an amplitude monopulse system with separate telecommunication and monopulse receivers according to an example embodiment. The amplitude monopulse may be received by the antenna 204B elements, e.g. 4 X-band elements, of the HGA 206. A directional coupler/filter, such as a 10 dB directional coupler/filter may couple the monopulse signal to hybrid couplers, such as 90° or 180° hybrid couplers, which may, in turn, convert amplitude differences into phase differences for receipt by a monopulse receiver 70A, such as a quad 4 slice monopulse receiver, to determine an AOA and/or angle error. The monopulse signal from the amplitude monopulse antenna 204B may also be received by a 4 way splitter and sent to a telecommunication receiver 70B, such as an X band receiver/transmitter, to receive telecommunication data FIG. 12B illustrates an example amplitude monopulse system with an integrated receiver according to an example embodiment. The amplitude monopulse may be received by the antenna 204B elements, e.g. 4 X band elements, of the HGA 206. The 4 received amplitude mono pulse may be feed to an integrated receiver, such as the SDR 70 as discussed in reference to FIG. 2, to determine the AOA and/or angle error and receive telecommunications data.

Figure 13:
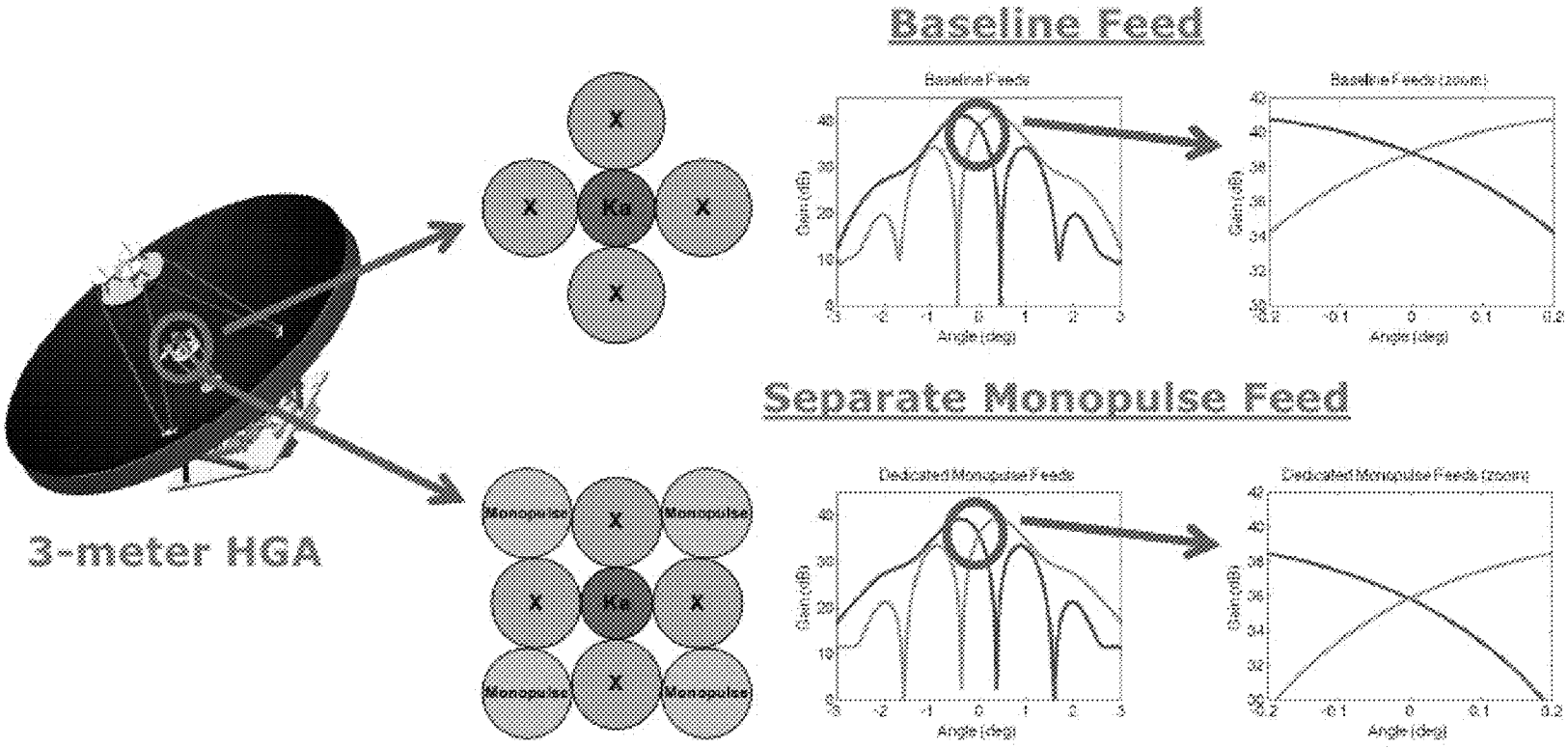
FIG. 13 illustrates a shared and dedicated monopulse feed according to an example embodiment.

FIG. 13 illustrates a shared and dedicated monopulse feed according to an example embodiment. The antenna 300 may include an HGA 206 having X-band feed horns that are shared with the monopulse antenna 204, such as depicted in the baseline feed depiction. The depicted fed signals have a gain of ~38 dB at 0° angle off HGA 206 boresight, ~41 dB, and ~34 dB respectively, at −0.2° and ~34 dB and ~41 dB, respectively, at +0.2°. In another example embodiment, the antenna 300 may include dedicated monopulse antenna 204 feed horns, such as depicted in the separate monopulse feed depiction. The depicted feed signals have a gain of ~36 dB at 0° angle off HGA 206 boresight, ~39 dB, and ~30 dB respectively, at −0.2° and ~30 dB and ~39 dB, respectively, at +0.2°.

Example Apparatus

Figure 14:
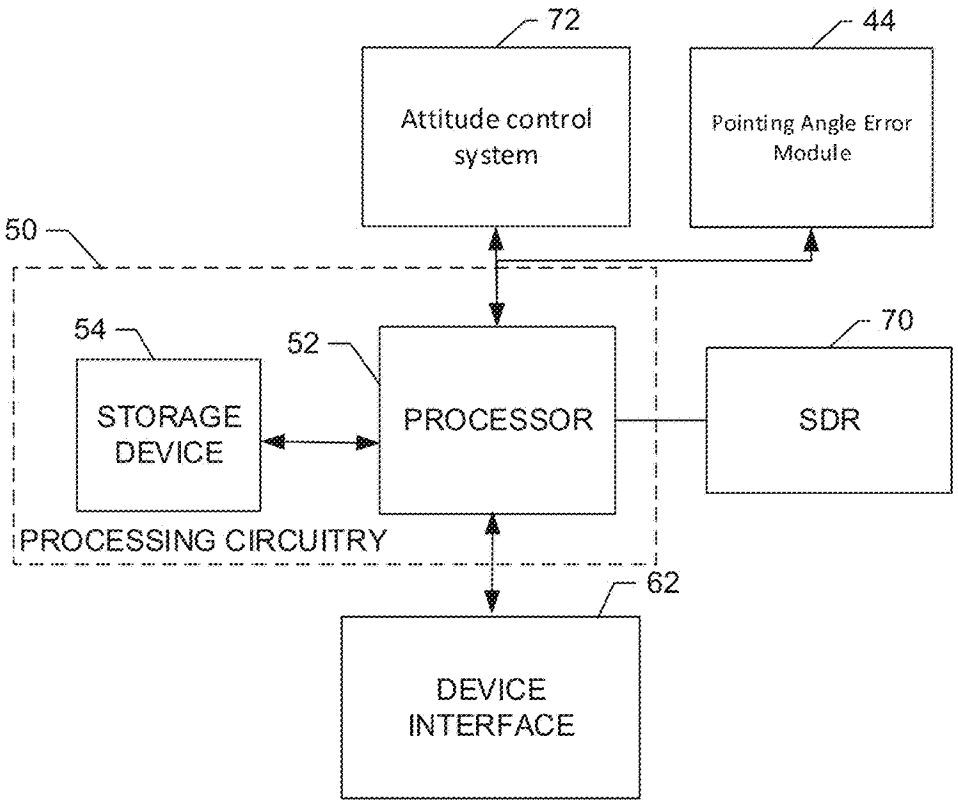
FIG. 14 illustrates a functional block diagram of a monopulse autotracking system that may be useful for pointing a high gain antenna according to an example embodiment.

FIG. 14 shows certain elements of a MAS according to an example embodiment. Some embodiments of the present MAS may be embodied wholly at a single device or by devices in a client/server relationship (e.g., the SDR 70 and an ACS 72). Furthermore, it should be noted that the devices or elements described below may not be mandatory and thus some may be omitted in certain embodiments.

In an example embodiment, the MAS may include or otherwise be in communication with processing circuitry 50 that is configured to perform data processing, application execution and other processing and management services according to an example embodiment of the present invention. In one embodiment, the processing circuitry 50 may include a storage device 54 and a processor 52 that may be in communication with or otherwise control a user interface 60 and a device interface 62. As such, the processing circuitry 50 may be embodied as a circuit chip (e.g., an integrated circuit chip) configured (e.g., with hardware, software or a combination of hardware and software) to perform operations described herein. However, in some embodiments, the processing circuitry 50 may be embodied as a portion of a server, computer, laptop, workstation or even one of various mobile computing devices. In situations where the processing circuitry 50 is embodied as a server or at a remotely located computing device, the user interface 60 may be disposed at another device (e.g., at a computer terminal or client device such as one of the clients 20) that may be in communication with the processing circuitry 50 via the device interface 62 and/or a network (e.g., network 30).

The device interface 62 may include one or more interface mechanisms for enabling communication with other devices and/or networks. In some cases, the device interface 62 may be any means such as a device or circuitry embodied in either hardware, software, or a combination of hardware and software that is configured to receive and/or transmit data from/to a network and/or any other device or module in communication with the processing circuitry 50. In this regard, the device interface 62 may include, for example, an antenna (or multiple antennas) and supporting hardware and/or software for enabling communications with a wireless communication network and/or a communication modem or other hardware/software for supporting communication via cable, digital subscriber line (DSL), universal serial bus (USB), Ethernet or other methods. In situations where the device interface 62 communicates with a network, the network may be any of various examples of wireless or wired communication networks such as, for example, data networks like a Local Area Network (LAN), a Metropolitan Area Network (MAN), and/or a Wide Area Network (WAN).

In an example embodiment, the storage device 54 may include one or more non-transitory storage or memory devices such as, for example, volatile and/or non-volatile memory that may be either fixed or removable. The storage device 54 may be configured to store information, data, applications, instructions or the like for enabling the apparatus to carry out various functions in accordance with example embodiments of the present invention. For example, the storage device 54 could be configured to buffer input data for processing by the processor 52. Additionally or alternatively, the storage device 54 could be configured to store instructions for execution by the processor 52. As yet another alternative, the storage device 54 may include one of a plurality of databases (e.g., a database server) that may store a variety of files, contents, or data sets. Among the contents of the storage device 54, applications may be stored for execution by the processor 52 in order to carry out the functionality associated with each respective application.

The processor 52 may be embodied in a number of different ways. For example, the processor 52 may be embodied as various processing means such as a microprocessor or other processing element, a coprocessor, a controller or various other computing or processing devices including integrated circuits such as, for example, an ASIC (application specific integrated circuit), an FPGA (field programmable gate array), a hardware accelerator, or the like. In an example embodiment, the processor 52 may be configured to execute instructions stored in the storage device 54 or otherwise accessible to the processor 52. As such, whether configured by hardware or software methods, or by a combination thereof, the processor 52 may represent an entity (e.g., physically embodied in circuitry) capable of performing operations according to embodiments of the present invention while configured accordingly. Thus, for example, when the processor 52 is embodied as an ASIC, FPGA or the like, the processor 52 may be specifically configured hardware for conducting the operations described herein. Alternatively, as another example, when the processor 52 is embodied as an executor of software instructions, the instructions may specifically configure the processor 52 to perform the operations described herein.

In an example embodiment, the processor 52 (or the processing circuitry 50) may be embodied as, include or otherwise control the pointing angle error module 44, which may be any means, such as, a device or circuitry operating in accordance with software or otherwise embodied in hardware or a combination of hardware and software (e.g., processor 52 operating under software control, the processor 52 embodied as an ASIC or FPGA specifically configured to perform the operations described herein, or a combination thereof) thereby configuring the device or circuitry to perform the corresponding functions of the pointing angle error module 44 as described below.

The pointing angle error module 44 may include tools to facilitate determination of the angle error of the HGA 206. In an example embodiment the pointing angle error module 44 may be configured for receiving a monopulse transmission by a monopulse antenna, determining an angle of arrival of the monopulse transmission, determining an angle error for a high gain antenna based on the angle of arrival of the monopulse transmission, and causing the positioning of the HGA antenna based on the angle error.

In an example embodiment, the processing circuitry 50 may include or otherwise be in data communication with the SDR 70. The SDR 70 may be substantially similar to the SDR described above in reference to FIG. 2.

In some example embodiments, the processing circuitry 50 may include or otherwise be in communication with the ACS 72. The ACS 72 may position the HGA 206 by controlling the attitude of the spacecraft 202 and/or controlling one or more spacecraft actuators, such as reaction wheels or gimbals of the HGA 206.

Example Distributed Graph Processing Flow Chart

Figure 15:
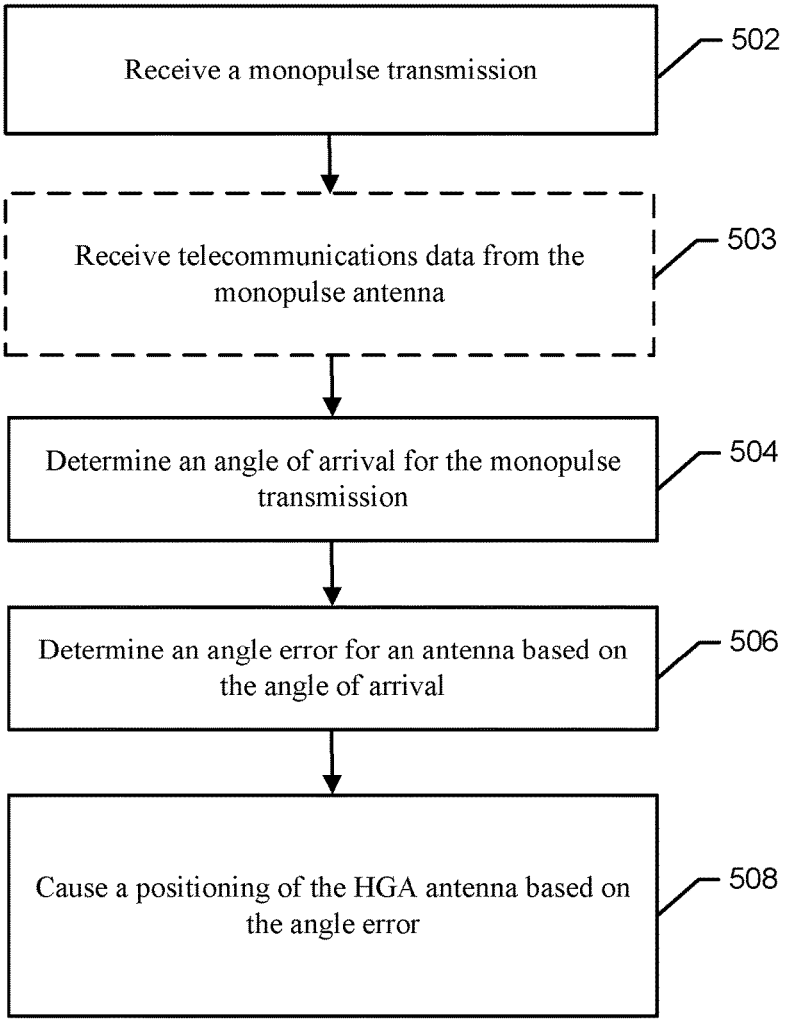
FIG. 15 illustrates a method for high gain antenna positioning based on a mono pulse according to an example embodiment.

From a technical perspective, the pointing angle error module 44 described above may be used to support some or all of the operations described above. As such, the MAS described in FIG. 14 may be used to facilitate the implementation of several computer program and/or network communication based interactions. As an example, FIG. 15 is a flowchart of a method and program product according to an example embodiment of the invention. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device, such as storage device 54 and executed by a processor in the MAS, such as processor 52. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the invention is shown in FIG. 15. The method may be employed for a MAS for pointing a HGA. The method may include, receiving a monopulse transmission, at operation 502. The method may also include determining an angle of arrival for the monopulse transmission, at operation 504. At operation 506, the method may include determining an angle error for an antenna based on the angle of arrival. The method, at operation 508, may include causing a positioning of the HGA antenna based on the angle error.

In an example embodiment, the method may optionally include, as denoted by the dashed box, receiving telecommunication data from the monopulse antenna, at operation 503. In an example embodiment, an apparatus for performing the method of FIG. 15 above may comprise a processor (e.g., the processor 52) or processing circuitry configured to perform some or each of the operations (502-508) described above. The processor may, for example, be configured to perform the operations (502-508) by performing hardware implemented logical functions, executing stored instructions, or executing algorithms for performing each of the operations. In some embodiments, the processor or processing circuitry may be further configured for additional operations or optional modifications to operations 502-508. In this regard, in an example embodiment, the high gain antenna, monopulse antenna, and processing circuitry are operably coupled to a space craft, monopulse transmission includes an earth based command uplink, and the high gain antenna is configured for transmission of a data downlink to an earth based receiver. In some example embodiments, the processing circuitry coherently tracks the command uplink within a narrow bandwidth to provide an accurate estimate of relative phase and/or amplitude for weak signal conditions. In an example embodiment, the monopulse antenna includes an amplitude monopulse configuration. In some example embodiments, the monopulse antenna includes a phase monopulse configuration. In an example embodiment, the monopulse antenna includes a phase monopulse configuration and an amplitude monopulse configuration. In some example embodiments, the monopulse antenna includes two pairs of orthogonal feed elements. In an example embodiment, the monopulse antenna includes three or more non-orthogonal feed elements. In some example embodiments, the monopulse antenna is disposed on the high gain antenna. In an example embodiment, the monopulse antenna includes an X band antenna. In some example embodiments, the high gain antenna includes a Ka band antenna. In an example embodiment, the processing circuitry includes a software defined radio. In some example embodiments, the processing circuitry comprises a passive radio frequency (RF) network and a software defined radio. In some example embodiment, the passive RF network comprises a three input/three output amplitude to phase converter. In an example embodiment, the processing circuitry comprises a software defined radio with three or more phase-coherent receiver channels. In an example embodiment, the determining the angle of arrival is based on a relative phase or a relative amplitude estimate and the geometry of the monopulse antenna. In some example embodiments, the processing circuitry is further configured to receive telecommunication data from the monopulse antenna. In an example embodiment, the determining the angle of arrival is based, at least in part on the telecommunication data.

Many modifications and other embodiments of the measuring device set forth herein will come to mind to one skilled in the art to which these inventions pertain having the benefit of the teachings presented in the foregoing descriptions and the associated drawings. Therefore, it is to be understood that the measuring device s are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A system comprising:

a high gain antenna;

a monopulse antenna for receiving a transmission including a monopulse transmission, the monopulse antenna comprising a plurality of antenna feeds, the monopulse antenna being affixed to the high gain antenna; and processing circuitry comprising:

a radio comprising:

a plurality of processing channels, each processing channel comprising an analog to digital converter configured to convert analog signals to digital signals based on the transmission, wherein each processing channel is associated with a respective one of the plurality of antenna feeds of the monopulse antenna; and a processor operably coupled to each of the processing channels, the processor configured to:

determine, based on the digital signals from the analog to digital converters, telecommunications receive data from the transmission, and determine, based on the digital signals from the analog to digital converters, an angle of arrival of the monopulse transmission;

wherein the processing circuitry is configured to:

determine an angle error for the high gain antenna based on the angle of arrival of the monopulse transmission, and cause the high gain antenna to be positioned based on the angle error.

2. The system of claim 1, wherein the high gain antenna, the monopulse antenna, and the processing circuitry are operably coupled to a space craft, wherein the monopulse transmission comprises an earth based command uplink, and wherein the high gain antenna is configured to transmit a data downlink to an earth based receiver.

3. The system of claim 2, wherein the processing circuitry is configured to coherently track the command uplink within a narrow bandwidth to provide an accurate estimate of at least one of a relative phase or amplitude.

4. The system of claim 1, wherein the monopulse antenna comprises an amplitude monopulse configuration.

5. The system of claim 1, wherein the monopulse antenna comprises a phase monopulse configuration.

6. The system of claim 1, wherein the monopulse antenna comprises a phase monopulse configuration and an amplitude monopulse configuration.

7. The system of claim 1, wherein the monopulse antenna comprises two pairs of orthogonal feed elements.

8. The system of claim 1, wherein the monopulse antenna comprises three or more non-orthogonal feed elements.

9. The system of claim, 1, wherein the monopulse antenna is disposed on the high gain antenna.

10. The system of claim 1, wherein the monopulse antenna comprises an X band antenna.

11. The system of claim 1, wherein the high gain antenna comprises a Ka band antenna.

12. The system of claim 1, wherein the radio comprises a software defined radio.

13. The system of claim 1, wherein the radio comprises a passive radio frequency (RF) network and a software defined radio.

14. The system of claim 13 wherein the passive RF network comprises a three input/three output amplitude to phase converter.

15. The system of claim 1, wherein the radio comprises a software defined radio with three or more phase-coherent receiver channels.

16. The system of claim 1, wherein the processor is configured to determine the angle of arrival based on a relative phase or a relative amplitude estimate and a geometry of the monopulse antenna.

17. The system of claim 1, wherein the monopulse antenna is a phased monopulse antenna comprising three medium gain antennas in an equilateral triangle orientation disposed on a subreflector of the high gain antenna.

18. A method comprising:

receiving a transmission comprising a monopulse transmission, the monopulse transmission being received by a monopulse antenna affixed to a high gain antenna, the monopulse antenna comprising a plurality of antenna feeds to a radio implemented by processing circuitry, the radio being configured to implement a processing channel for each of the antenna feeds, each processing channel comprising an analog to digital converter;

converting, by each of the analog to digital converters, analog signals to digital signals based on the transmission;

determining, by a processor of the radio and based on the digital signals from the analog to digital converters, telecommunications receive data based on the transmission;

determining, by the processor of the radio and based on the digital signals from the analog to digital converters, an angle of arrival of the monopulse transmission;

determining, using processing circuitry, an angle error for a high gain antenna based on the angle of arrival of the monopulse transmission; and causing the high gain antenna to be positioned based on the angle error.

19. The method of claim 18, wherein the processing circuitry comprises the radio, and the radio comprises a software defined radio, and wherein the high gain antenna, the monopulse antenna, and the processing circuitry are operably coupled to a space craft, wherein the monopulse transmission comprises an earth based command uplink, and wherein the high gain antenna is configured to transmit a data downlink to an earth based receiver.

* * * * *